United States Patent [19]

Sasaki

[11] Patent Number: 4,684,319

[45] Date of Patent: Aug. 4, 1987

[54] TURBOCHARGER WITH VARIABLE NOZZLE MECHANISM

[75] Inventor: Shoji Sasaki, Mishima, Japan

[73] Assignee: Toyota Jidosha Kabushiki Kaisha, Toyota, Japan

[21] Appl. No.: 823,411

[22] Filed: Jan. 28, 1986

[30] Foreign Application Priority Data

Jan. 29, 1985 [JP] Japan ..... 60-9974[U]

[51] Int. Cl.[4] ..... F01D 17/16

[52] U.S. Cl. ..... 415/164; 415/219 R

[58] Field of Search ..... 415/150, 163, 164, 160, 415/219 R; 417/406, 407; 60/602

[56] References Cited

U.S. PATENT DOCUMENTS

| | | | |
|---|---|---|---|
| 2,860,827 | 11/1958 | Eoli | 415/164 X |
| 3,101,926 | 8/1963 | Weber | 415/164 X |
| 4,179,247 | 12/1979 | Osborn | 415/163 X |
| 4,242,040 | 12/1980 | Swearingen | 415/163 X |
| 4,355,850 | 10/1982 | Okano | 417/407 X |

FOREIGN PATENT DOCUMENTS

| | | | |
|---|---|---|---|
| 50-94317 | 7/1975 | Japan . | |
| 58-82439 | 6/1983 | Japan . | |
| 58-122305 | 7/1983 | Japan | 415/164 |
| 58-111324 | 7/1983 | Japan . | |
| 58-176417 | 10/1983 | Japan . | |

*Primary Examiner*—Robert E. Garrett
*Assistant Examiner*—Joseph M. Pitko
*Attorney, Agent, or Firm*—Cushman, Darby & Cushman

[57] ABSTRACT

A turbocharger with a variable nozzle mechanism for an internal combustion engine in which nozzle vanes rotatably arranged inside of a turbine housing are driven by a disk plate rotatably arranged outside of the turbine housing and a center housing via rotation transmitting means. The disk plate is constructed as a single integral annular plate so that the inside bearing surface can be manufactured as a true circle by machining. The center housing comprises a center housing main body on which the disk plate is rotatably mounted and a flange portion which is selectively separable from the center housing main body. The outside diameter of the flange portion is constructed smaller than the inside diameter of the disk plate from the axially intermediate portion at which the disk plate is mounted up to the end portion at which the separable flange portion is fixed, in order to enable the disk plate to be mounted onto the outside surface of the center housing main body. The above structure improves rotation of the disk plate and reliability of the variable nozzle mechanism.

7 Claims, 4 Drawing Figures

TURBOCHARGER WITH VARIABLE NOZZLE MECHANISM

BACKGROUND OF THE INVENTION

1. Field of the Invention

The present invention relates to a variable nozzle mechanism of a turbocharger such as for an internal combustion engine.

2. Description of the Prior Art

For an internal combustion engine with a turbocharger, it is known that a variable nozzle mechanism, provided at the inlet of the turbine, effectively increases the output torque of the engine in a range of low engine speeds, because the boost pressure can be increased by throttling the inlet area of the turbine via the variable nozzle mechanism. Japanese Utility Model Publication SHO 58-82439, Japanese Utility Model Publication SHO 58-111324, Japanese Patent Publication SHO 58-176417 and Japanese Patent Publication SHO 50-94317 disclose such devices.

In the driving mechanism of nozzle vanes for the turbocharger disclosed in Japanese Utility Model Publication SHO 58-82439, the contents of which are incorporated herein by reference, guide means is provided at the outer surface of the center housing and a composite disk plate is rotatably supported by the guide means so as to have a common axis with the turbocharger. The rotation of the disk plate is transmitted via a ring plate coupled with the disk plate and a lever rotatably coupled with the ring to the nozzle vanes, thereby rotating the nozzle vanes. Since the flange portions for fixing the compressor housing and the turbine housing are integrally constructed with the center housing and have larger diameters than the inner diameter of the disk plate, the disk plate has to be manufactured in two portions, split along a diameter, in order to mount it onto the guide means and has to be assembled into a single composite annular plate by coupling the two separate portions after being mounted on the guide means. The separate portions are coupled together by the ring plate which is coupled with the disk plate at the outside periphery of the disk plate.

However, it was difficult to manufacture the composite disk plate so that its inner surface is a true circle as a result of the separate portions. Thus, the composite disk plate is likely to slide poorly with respect to the guide means and to momentarily bind during rotation. This decreases the reliability of the variable nozzle mechanism.

SUMMARY OF THE INVENTION

An object of the present invention is to provide an inner bearing surface of an annular disk plate which can be manufactured as a true circle, in a variable nozzle mechanism of a turbocharger in which variable vanes are driven to rotate corresponding to the rotation of the disk plate provided outside of the turbine housing.

According to the present invention, the above object is achieved by a turbocharger with variable nozzle mechanism having a plurality of nozzle vanes rotatably housed in a turbine housing. A disk plate is rotatably arranged outside of the turbine housing and coupled via rotation transmitting means with the nozzle vanes so that the rotation of the disk plate is transmitted to the nozzle vanes. A center housing includes a center housing main body which rotatably supports the disk plate via a guide bearing and flange portions to which the turbine housing and a compressor housing are fixed respectively. The disk plate consists of a single integral annular plate which is not divided into portions. The disk plate has an inner diameter smaller than the outside diameters of the flange portions. In order to enable the integral disk plate to be mounted on the guide bearing which is provided at an axially intermediate portion of the center housing, at least one of the flange portions is selectively separable from the center housing main body and the outside diameter of the center housing is constructed smaller than the inner diameter of the disk plate from the axially intermediate portion at which the disk plate is rotatably supported via the guide bearing up to the end portion at which the separable flange portion is fixed to the center housing main body.

Since the disk plate consists of a single integral plate, the inner bearing surface can be machined to be a true circle. Therefore, rotation of the disk plate becomes smooth and reliability of the variable nozzle mechanism is improved to a great extent.

BRIEF DESCRIPTION OF THE DRAWINGS

These and other objects and advantages of the invention will become more apparent and more readily appreciated from the following detailed description of the presently preferred exemplary embodiment of the invention taken in conjunction with accompanying drawings, of which.

DETAILED DESCRIPTION OF THE PREFERRED EMBODIMENTS

(FIRST EMBODIMENT)

Figure 1:
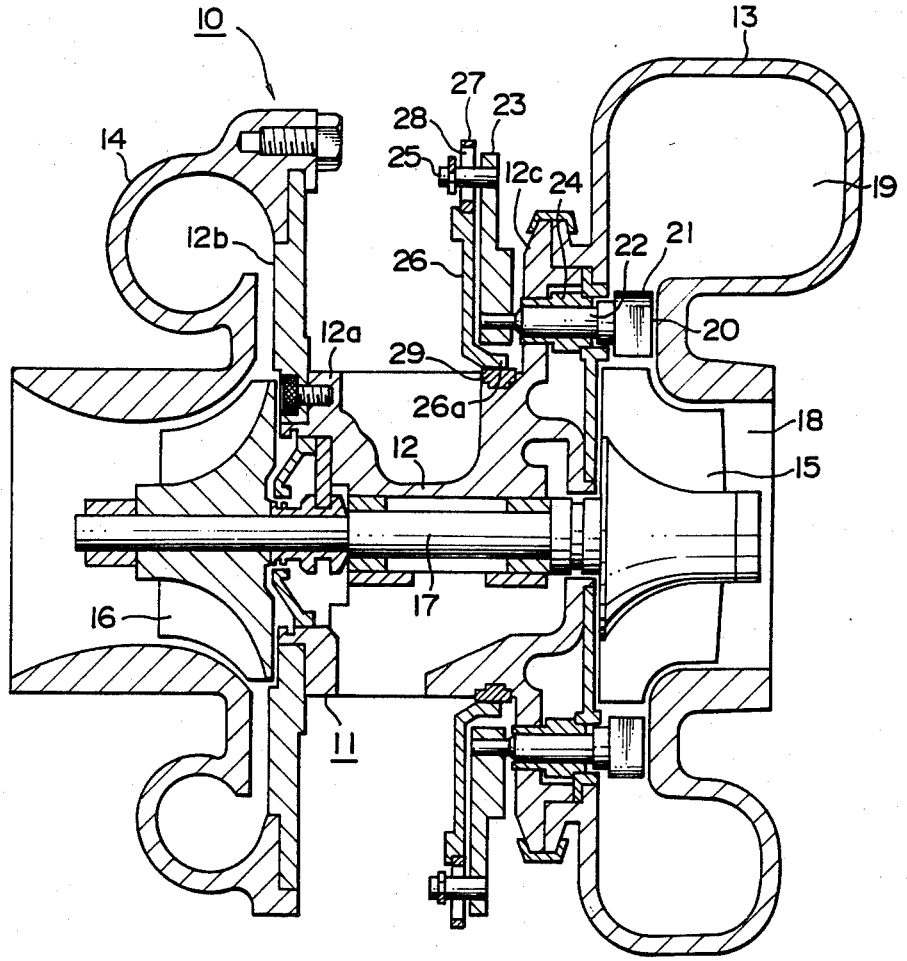
FIG. 1 is a sectional view of a turbochager with variable nozzle mechanism according to a first embodiment of the present invention.
Figure 2:
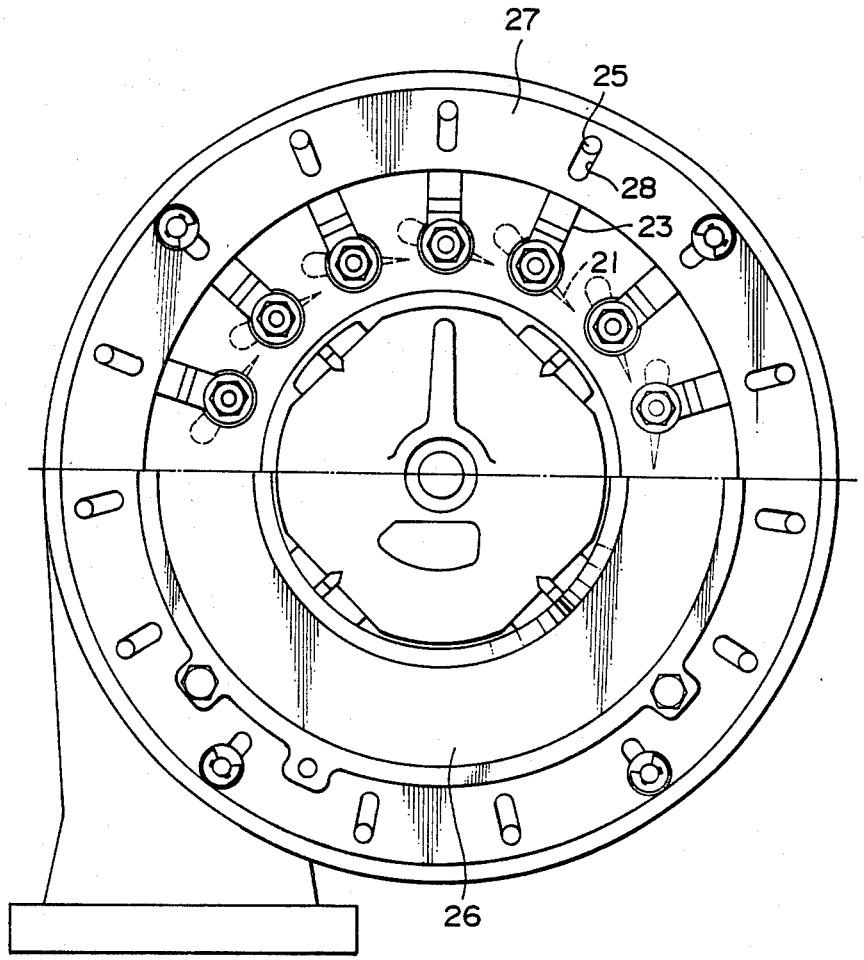
FIG. 2 is a front view of variable nozzle vanes and the vicinity thereof of the turbocharger of FIG. 1.
Figure 3:
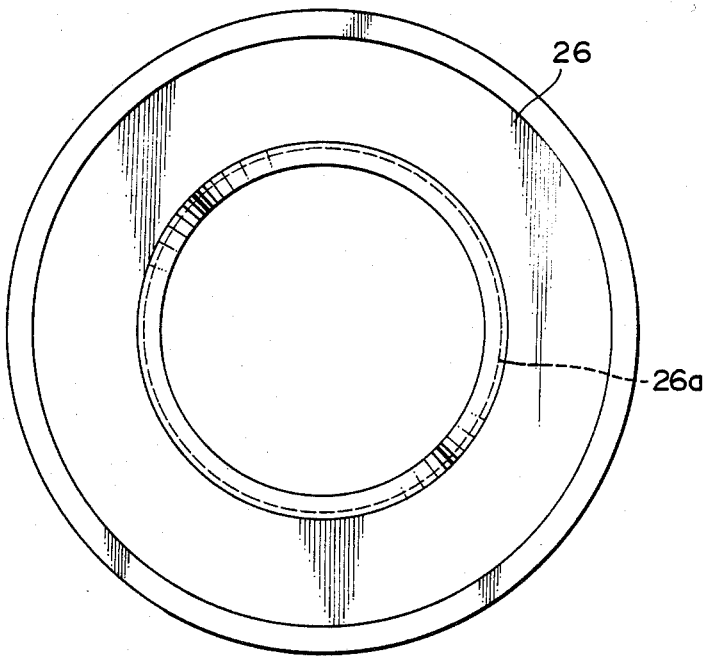
FIG. 3 is a front view of a disk plate of FIG. 1.

FIGS. 1 to 3 show a first embodiment of the present invention. First, the overall structure of the turbocharger will be explained referring to FIG. 1. A turbocharger housing 11 comprises a center housing 12, a turbine housing 13 provided at one end of center housing 12 and a compressor housing 14 provided at the other end of center housing 12. Turbine housing 13 is connected to the exhaust side of an internal combustion engine (not shown) and compressor housing 14 is connected to the intake side of the engine.

A turbine rotor 15 is rotatably housed in turbine housing 13 and an impeller 16 is rotatably housed in compressor housing 14. Turbine rotor 15 and impeller 16 are connected by a turbine shaft 17 which penetrates center housing 12 on the axis of the turbocharger. Turbine shaft 17 is rotatably supported via shaft bearings by center housing 12 and turbine rotor 15, impeller 16 and turbine shaft 17 rotate together in housing 11.

Turbine housing 13 includes a turbine rotor housing room 18 at its radially inner portion and spiral room 19 at its radially outer portion. Turbine rotor housing room 18 and spiral room 19 are connected to each other via a nozzle housing portion 20. The engine exhaust gas flows through nozzle housing portion 20 from room 19 to room 18.

In nozzle housing portion 20, as shown in FIG. 2, a plurality of nozzle vanes 21 are arranged equally spaced in the circumferential direction. When the exhaust gas passes the nozzle housing portion 20, the direction of the flow is changed and the flowing speed is increased by nozzle vanes 21. When the exhaust gas enters turbine rotor housing room 18, it gives its energy to turbine rotor 15. The energy given to turbine rotor 15 is consumed through driving impeller 16 and increasing the boost pressure of the turbocharger.

Nozzle vanes 21 are rotatable by the variable nozzle mechanism described below and the throttling area between nozzle vanes 21 is variable. Each nozzle vane 21 has an integral shaft 22 which rotates together with nozzle vane 21 around the axis of shaft 22. Shaft 22 penetrates the wall of turbine housing 13 and extends outside of turbine housing 13. A lever 23 is, at one end, fixed to the end of each shaft 22 outside of turbine housing 12 so as to rotate together with shaft 22 and nozzle vane 21 around the axis of shaft 22. Shaft 22 is rotatably supported via nozzle vane shaft bearing 24 by the wall of turbine housing 13. A pin 25 is fixed to the other end of each lever 23 and pin 25 extends in the direction opposite to turbine housing 13 and parallel to the axis of the turbocharger. Outside of turbine housing 13 and center housing 12, an annular ring 27 is rotatably arranged so as to rotate around the axis of the turbocharger, that is, the axis of turbine shaft 17. In the annular ring 27, a plurality of slits 28, as many as nozzle vanes 21, are provided and each slit 28 extends in the radial direction of the turbocharger. Each pin 25 slidably and rotatably engages each slit 28. By the engaging mechanism, ring 27 can rotatably be coupled with lever 23, absorbing the positional difference between pin 25 which rotates around the axis of vane shaft 22 and ring 27 which rotates around the axis of turbine shaft 17. By the driving mechanism, the rotation of ring 27 can be smoothly transmitted to drive nozzle vahes 21. Ring 27, pin 25, lever 23 and vane shaft 22 constitute rotation transmitting means.

Outside of turbine housing 13 and center housing 12, an annular disk plate 26 is rotatably arranged so as to have a common axis with the turbocharger. Ring 27 is coupled with disk plate 26 at the outside periphery of disk plate 26 and rotates together with disk plate 26. Disk plate 26 is supported via guide bearing 29 by center housing 12. Guide bearing 29 is provided at the outer surface of the axially intermediate portion of center housing 12. In the first embodiment of the present invention, guide bearing 29 is constructed of an annular plane bearing. Disk plate 26 has a boss **26*a* at the radially inner portion. Boss 26*a* extends parallel to the axis of turbocharger and slidably contacts the outer surface of guide bearing 29 at the inner surface of boss 26*a***.

Disk plate 26 is a single integral annular plate. In other words, disk plate 26 is not a composite plate which is divided in the circumferential direction and has to be coupled to form a circular plate. The inner surface of boss **26*a* of disk plate 26 is manufactured to be a true circle by applying machining to the inner surface of boss 26*a***.

Center housing 12 comprises a center housing main body **12*a*, a flange portion 12*b* to which compressor housing 14 is fixed and a flange portion 12*c* to which turbine housing 13 is connected. Disk plate 26 has an inside diameter smaller than the outside diameters of flange portions 12*b* and 12*c*. In order to mount single annular disk plate 26 onto guide bearing 29, at least one of flange portions 12*b* and 12*c* must be separable from center housing main body 12*a*. In the first embodiment of the present invention, flange portion 12*b* to which compressor housing 14 is fixed is constructed to be separable from center housing main body 12*a*. Though not shown in FIGS. 1 to 3, such substitute design may be adopted that flange portion 12*c* to which turbine housing 13 is fixed or, in fact, both flange portions 12*b* and 12*c* my be separable. Separable flange portion 12*b* or 12*c* is fixed to center housing main body 12*a* after disk plate 26 has been mounted onto guide bearing 29. The outside diameter of center housing main body 12*a* is constructed smaller than the inside diameter of disk plate 26 from the axially intermediate porion at which disk plate 26 is supported via guide bearing 29 by center housing main body 12*a* up to the end portion of center housing main body 12*a* at which separable flange portion 12*b* or 12*c* is fixed to center housing main body 12*a***.

Disk plate 26 may be manipulated to control the turbocharger in the same manner as has been customary in the past.

Next, effects of the first embodiment of the present invention will be explained.

Since disk plate 26 is constructed of a single integral annular plate, the inner surface of disk plate 26 can be formed as a true circle by applying machining. Single integral disk plate can be mounted onto center housing main body **12*a* by the separable construction of flange 12*b* and/or 12*c***.

Since the inner surface of disk plate 26 is a true circle, disk plate 26 rotates smoothly exactly around the axis of the turbocharger. Therefore, the accuracy with which nozzle vanes 21 are driven is increased. Also, disk plate 26 is not likely to momentarily bind and reliability of the variable nozzle mechanism is improved.

(SECOND EMBODIMENT)

Figure 4:
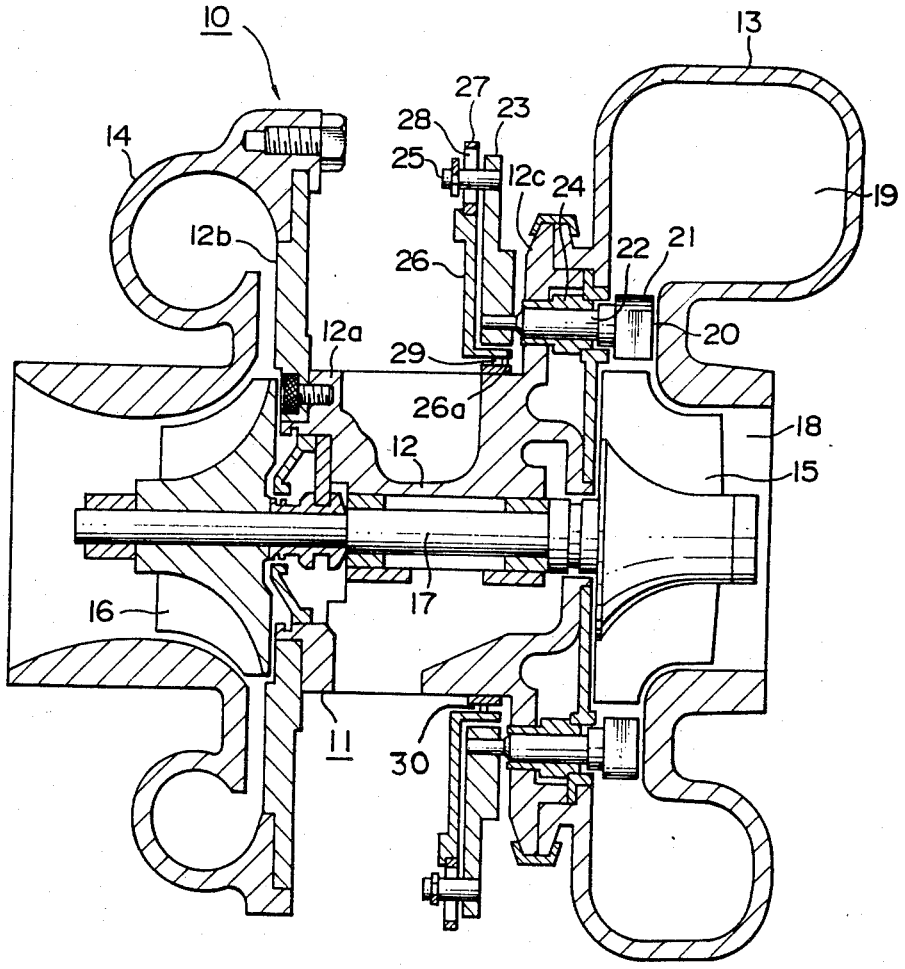
FIG. 4 is a sectional view of a turbocharger with variable nozzle mechanism according to a second embodiment of the present invention.

FIG. 4 shows a second embodiment of the present invention.

The second embodiment differs from the first embodiment in the structure of a guide bearing 29 which supports disk plate 26 at the outside surface of center housing 12. Other structures are the same as those of the first embodiment. Therefore, the explanations about the same structures will be omitted by attaching the same reference numerals in FIG. 4 as those in FIGS. 1 to 3 and only the different structure will be explained.

In the second embodiment, guide bearing 29 is constructed of a ball bearing. Ball bearing 30 has its outer race constructed separately from boss **26*a* of single integral annular disk plate 26. However, the outer race of ball bearing 30 may be omitted by constructing boss 26*a* of disk plate 26 as the outer race of ball bearing 30**.

The same effects as those of the first embodiment can be obtained in the second embodiment.

Although only a few exemplary embodiments of the present invention have been described in detail above, those skilled in the art will readily appreciate that many modifications are possible in the exemplary embodiments without materially departing from the novel teachings and advantages of the invention. Accordingly, all such modifications are intended to be included within the scope of the present invention as defined in the following claims.

What is claimed is:

1. Apparatus for variably controlling a turbine having a housing comprising:

a plurality of nozzle vanes adapted to be rotatably housed in said turbine housing;

a disk plate rotatably provided outside of said turbine housing, said disk plate consisting of a single integral plate;

rotation transmitting means including a plurality of shafts, each of said shafts attached to a nozzle vane, for operatively coupling said disk plate with said nozzle vanes so that the rotation of said disk plate is transmitted to said nozzle vanes; and a center housing including:

a center housing main body having a turbine housing side, a compressor housing side, main bearings adapted for supporting a turbine shaft, for supporting said disk plate for rotation;

a first flange portion integral with said turbine housing side of said center housing main body, adapted to be fixed to a turbine housing, and having an outside diameter larger than an inner diameter of said disk plate; and a second flange portion being separably fixed at one end to said compressor housing side of said center housing main body and being able to be fixed at a second end to a compressor housing;

said center housing main body having an outside diameter smaller than said inner diameter of said disk plate from the portion at which said disk plate is rotatably mounted up to the end portion at which said second flange portion is fixed.

2. Apparatus as in claim 1 further comprising a guide bearing disposed between said center housing and said disk plate.

3. Apparatus as in claim 2, wherein said guide bearing comprises an annular plane bearing and the inner surface of said disk plate slidably contacts said plane bearing in the circumferential direction.

4. Apparatus as in claim 2, wherein said guide bearing comprises a ball bearing.

5. Apparatus as in claim 4, wherein the radially inner portion of said disk plate constitutes the outer race of said ball bearing.

6. A turbocharger with variable nozzle mechanism comprising:

a turbine having a main shaft and an inlet;

a turbine housing disposed about said turbine;

a compressor operatively coupled to said turbine;

a plurality of nozzle vanes arranged at said inlet of said turbine and housed in said turbine housing, each of said nozzle vanes having an integral shaft which penetrates the wall of said turbine housing and being rotatably supported by said turbine housing so as to rotate around the axis of said shaft;

a plurality of levers, each of said levers being fixed, at one end of said lever, to one of said shafts, respectively, so as to rotate together with said shaft;

an annular ring rotatably arranged outside of a turbine housing so as to have a common axis with said turbo-charger, said ring being rotatably coupled with each of said levers at another end of said level opposite to said one end;

a disk plate rotatably arranged outside of said turbine housing so as to have a common axis with said turbocharger, said disk plate consisting of a single integral annular plate with which said annular ring is coupled at the outside periphery of said disk plate; and a center housing including:

a center housing main body having a turbine housing side, a compressor housing side, main bearings for supporting said turbine shaft, for supporting said disk plate for rotation at an axially intermediate portion thereof;

a first flange portion integral with said turbine housing side of said center housing main body, fixed to said turbine housing, and having an outside diamter larger than an inside diameter of said disk plate; and a second flange portion separably fixed at one end to said compressor hosuing side of said center housing main body and fixed at a second end to a housing of said compressor;

said center housing main body having an outside diameter smaller than said inside diameter of said disk plate from said intermediate portion to an end portion thereof at which said second flange portion is fixed.

7. The turbocharger as in claim 6 wherein each of said levers includes a pin fixed at said another end of said lever and said annular ring defines a plurality of radially extending slits, one of said pins being slidably disposed in each of said slits, respectively.

* * * * *